US007282901B2

(12) United States Patent
Pletersek

(10) Patent No.: US 7,282,901 B2
(45) Date of Patent: Oct. 16, 2007

(54) TEMPERATURE INDEPENDENT LOW REFERENCE VOLTAGE SOURCE

(76) Inventor: Anton Pletersek, Bohova 19c, Hoce (SI) 2311

( * ) Notice: Subject to any disclaimer, the term of this patent is extended or adjusted under 35 U.S.C. 154(b) by 49 days.

(21) Appl. No.: 10/563,858

(22) PCT Filed: Jul. 9, 2003

(86) PCT No.: PCT/SI03/00022

§ 371 (c)(1),
(2), (4) Date: Jan. 9, 2006

(87) PCT Pub. No.: WO2005/006102

PCT Pub. Date: Jan. 20, 2005

(65) Prior Publication Data

US 2006/0176041 A1 Aug. 10, 2006

(51) Int. Cl.
*G05F 3/16* (2006.01)

(52) U.S. Cl. ..... 323/313; 323/315; 323/907

(58) Field of Classification Search ..... 323/313, 323/314, 315, 907

See application file for complete search history.

(56) References Cited

U.S. PATENT DOCUMENTS

| | | | | |
|---|---|---|---|---|
| 5,325,045 A | 6/1994 | Sundby | ..... | 323/313 |
| 5,614,816 A | 3/1997 | Nahas | ..... | 323/316 |
| 5,982,201 A | 11/1999 | Brokow et al. | ..... | 327/53 |
| 6,016,051 A * | 1/2000 | Can | ..... | 323/315 |
| 6,177,788 B1 * | 1/2001 | Narendra et al. | ..... | 323/315 |
| 6,225,856 B1 | 5/2001 | Toth | ..... | 327/539 |
| 7,122,997 B1 * | 10/2006 | Werking | ..... | 323/313 |
| 7,157,893 B2 * | 1/2007 | Lee | ..... | 323/314 |
| 2003/0001660 A1 | 1/2003 | Yang | ..... | 327/540 |

* cited by examiner

*Primary Examiner*—Jeffrey Sterrett
(74) *Attorney, Agent, or Firm*—Jacobson Holman PLLC

(57) ABSTRACT

A circuit of the invention comprises a low voltage PTAT source. Current generators (t1, t2) are controlled so that their output currents I1 and I2, respectively, have temperature properties of the quotient $V_{PTAT}/R$. The current I1 is conducted to a first terminal (X) on a first connection of a composition of series connected resistors (Ra, Rb), a second connection thereof being grounded. A transistor (T) is diode-like forward connected between the first terminal (X) and the ground. The current I2 is conducted to a second terminal (Y), preferably being at the same time a common connection (Z) of the resistors (Ra, Rb). Reference voltage Vr is tapped from the connection (Z). Said resistors (Ra, Rb) are manufactured in the n_-well technology in the same way as the resistor (R), with the resistance of which the mentioned quotient is generated.

Figure 1:
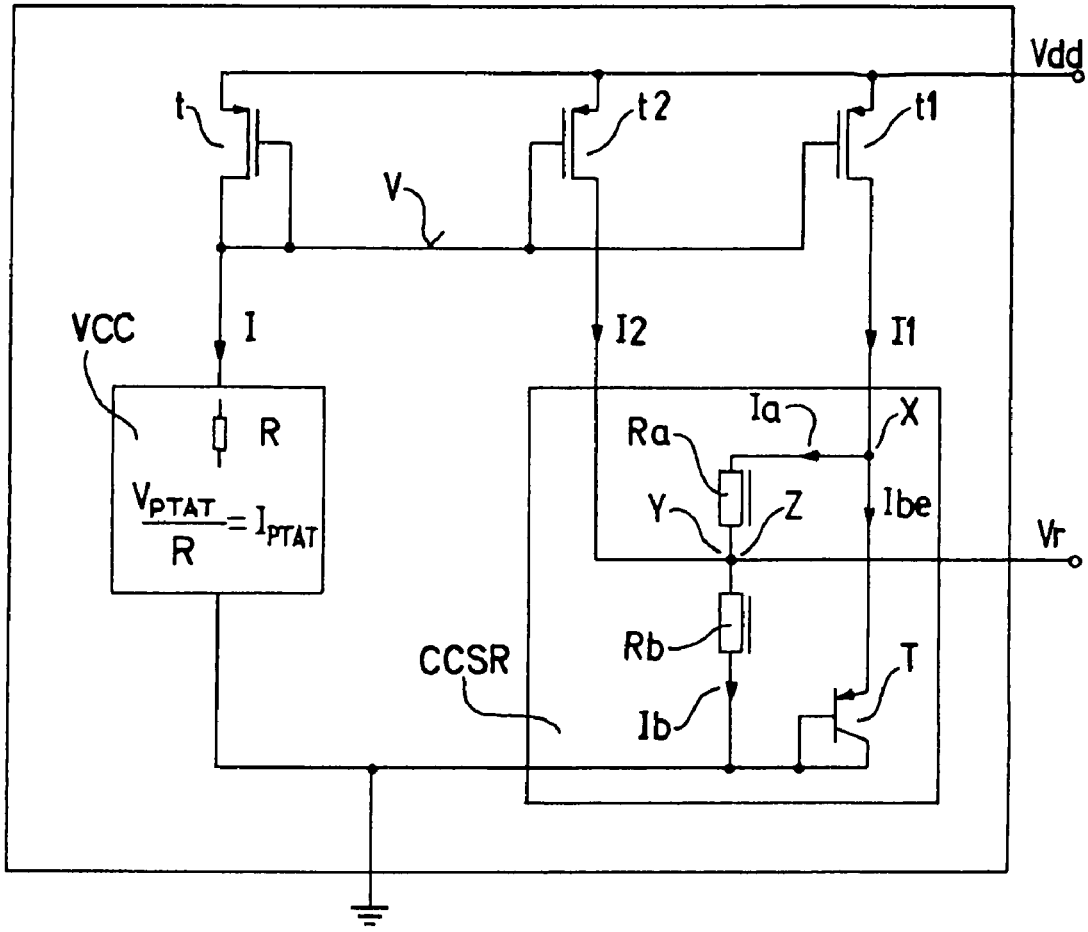

The proposed circuit is distinguished for its current controlled summing regulator, which is also suggested by the invention, and which makes it possible that in a temperature range from −50° C. to 150° C. a very low reference voltage of 0.35 V at low supply voltage lying below 0.9 V is reached, and does not simultaneously introduce nonideal behaviour like offset voltage.

6 Claims, 3 Drawing Sheets

TEMPERATURE INDEPENDENT LOW REFERENCE VOLTAGE SOURCE

This is a nationalization of PCT/SI03/000022 filed Jul. 9, 2003 and published in English.

The invention relates to a temperature independent low reference voltage source, comprising a low voltage source, being proportional to the absolute temperature, with the reference voltage at the output of the voltage source according to the invention lying within a technically important temperature range considerably below 1 volt and for the source according to the invention requires a supply voltage lying considerably below 1 volt.

Almost each integrated circuit uses a source of temperature independent reference voltage to perform various functions. A reference voltage source based on an extraction of silicon-energy-gap potencial needs supply voltage exceeding 1.2 V. In order to make battery supply at a voltage of 1.2 V or below applicable various reference voltage sources, otherwise based, have been proposed.

The patent U.S. Pat. No. 5,614,816 describes a circuit of a temperature independent low reference voltage source, the summing circuit of which combines divided down voltage of a bipolar junction and multiplied voltage of a source (PTAT source), the voltage of which is proportional to the absolute temperature. The described circuit should be supplied with supply voltage ranging near 0.9 V or below and generates reference voltage lying near 0.9 V or below. It uses an operational amplifier, which enters nonideal behaviour due to offset voltage. Furthermore, a threshold voltage difference of MOS transistors is applied as the bipolar junction voltage, although it is known that the temperature properties of bipolar transistors and those of MOS transistors are different.

Further temperature independent low reference voltage sources are described in patents U.S. Pat. Nos. 5,325,045 and 6,225,856. They comprise an operational amplifier needing a higher supply voltage due to input in-phase voltage as well as due to the required supply voltage. Said supply voltage exceeds even 2 V, because inner voltages, such as Vbe voltage across a diodelike forward connected bipolar transistor or Vt threshold voltage of a MOS transistor are summed.

None of said reference voltage sources is applicable at a really low supply voltage lying below 0.7 V, which appears to be a serious limitation, for a battery voltage drops at an increased instantaneous load and is lower at low temperatures and in an exhausted battery.

Consequently, the technical problem to be solved by the present invention is how to construct an integrated low reference voltage source, the reference voltage being temperature independent, in a way that the reference voltage will be really low and the source will need a low supply voltage, however, it will comprise an assembly of electronic elements, controlled only by temperature and joining two complementary temperature variations as well as possessing self-regulation properties.

Novel features considered characteristic of this invention are set forth with particularity in the appended claims.

The source of temperature independent low reference voltage of the invention is distinguished for its the current controlled summing regulator, which is also suggested by the invention, and which makes it possible that in a temperature range from −50° C. to 150° C. a very low reference voltage of 0.35 V at low supply voltage lying below 0.9 V is reached and does simultaneously not introduce nonideal behaviour typical of an operational amplifier.

Figure 2:
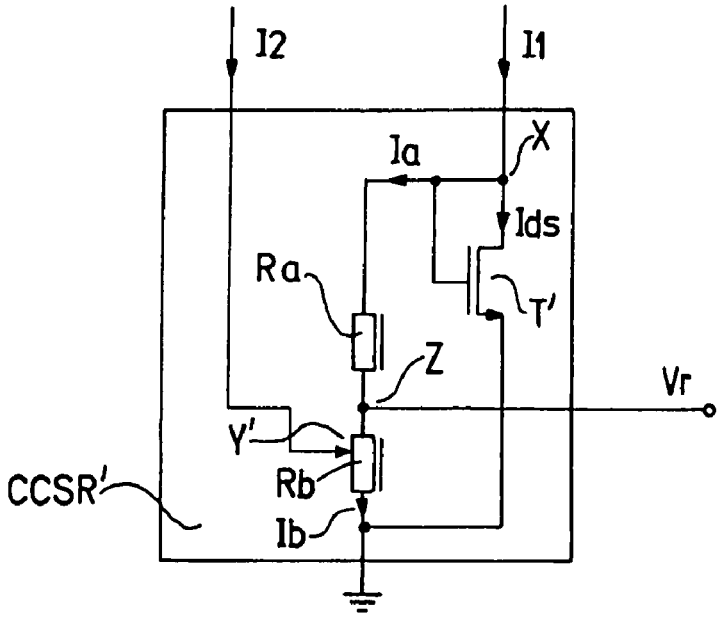
Figure 3:
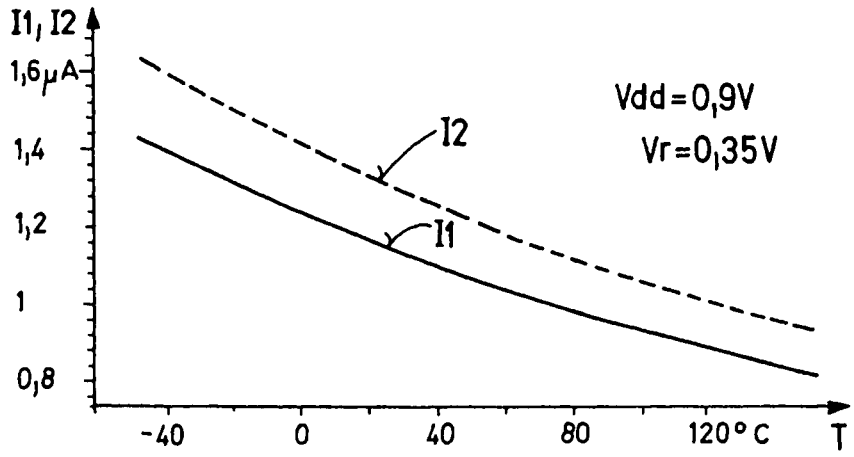
Figure 4:
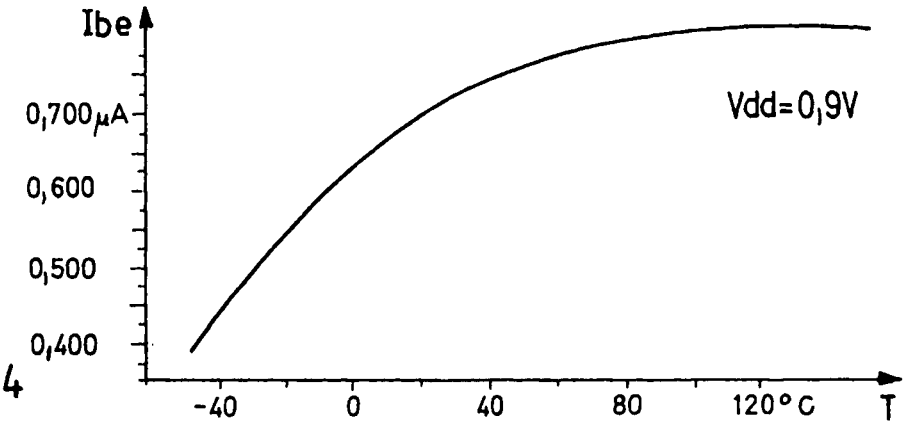
Figure 5:
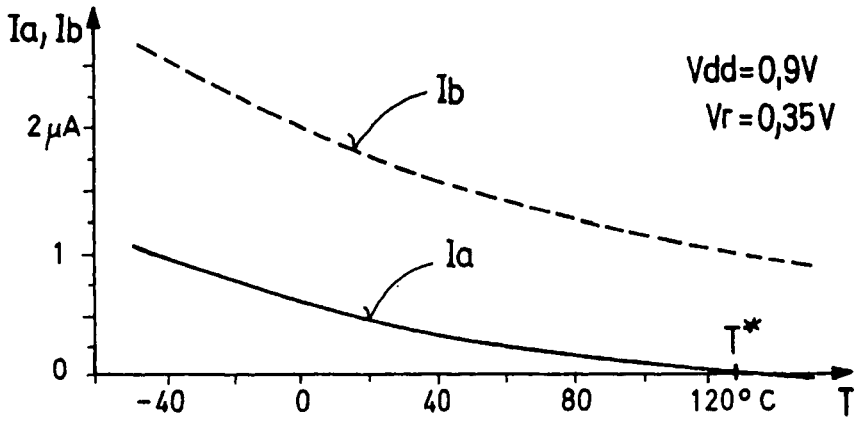
Figure 6:
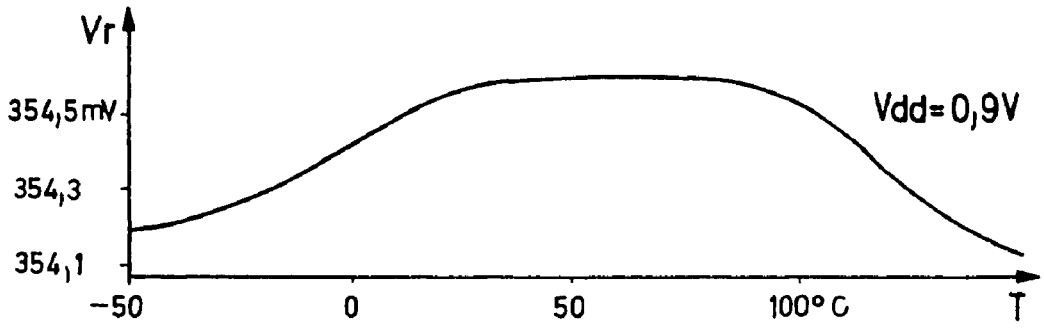
Figure 7:
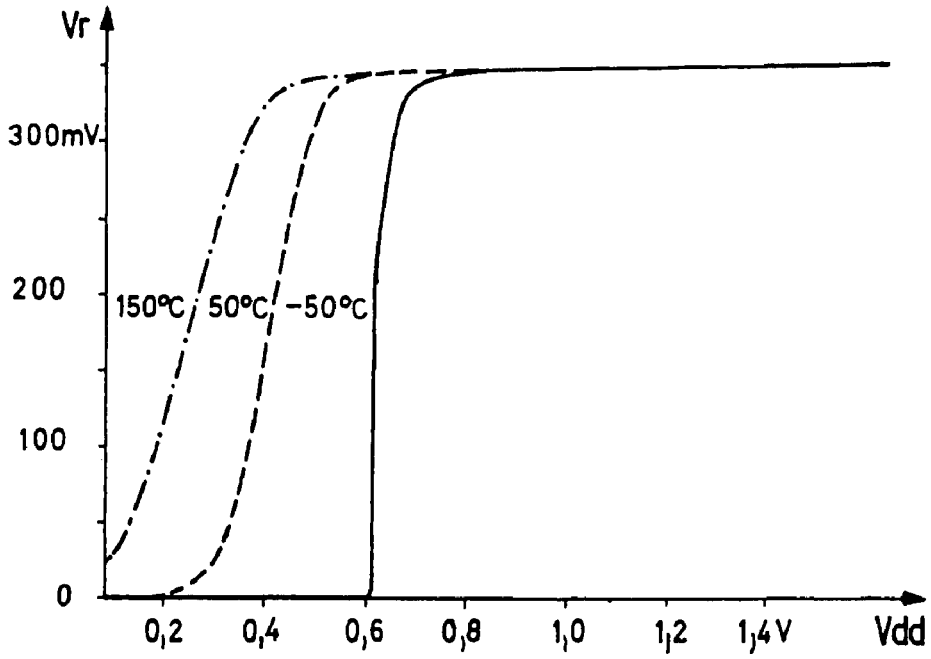

The invention will now be explained in more detail by way of description of two embodiments and with reference to the accompanying drawing and graphs representing in:

FIG. 1 schematic presentation of a source having temperature independent low reference voltage according to the first embodiment of the invention, FIG. 2 schematic presentation of a current controlled summing regulator according to the second embodiment of the invention, FIG. 3 graph of temperature dependence of the first and the second current flowing into the current controlled summing regulator according to the invention, FIG. 4 a graph of the temperature dependence of a current flowing through a diodelike forward connected transistor in the current controlled summing regulator according to the first embodiment of the invention at supply voltage of 0.9 V and the reference voltage of 0.35 V, FIG. 5 graph of temperature dependence of a current flowing through first resistor and of temperature dependence of a current flowing through second resistor in the current controlled summing regulator according to the first embodiment of the invention at supply voltage of 0.9 V and reference voltage of 0.35 V, FIG. 6 a graph of the temperature dependence of a reference voltage at the output of the source of a low temperature independent reference voltage according to the first embodiment of the invention at supply voltage of 0.9 V, and FIG. 7 a graph of the supply voltage dependence of a reference voltage at the output of the source of temperature independent low reference voltage according to the first embodiment of the invention at temperatures −50° C., 50° C. and 150° C.

A circuit of a source having temperature independent low reference voltage Vr according to the invention consists of a voltage-to-current converter VCC comprising among other elements a low voltage source (a low voltage PTAT source), the voltage $V_{PTAT}$ of which is proportional to the absolute temperature and a resistor R, as well as of a current-to-voltage converter t, current generators t1, t2 and of a current controlled summing regulator CCSR (FIG. 1).

It is important for the source circuit of the invention it is important that the PTAT voltage source comprised in the voltage-to-current converter VCC is a low voltage source and that the resistor R, also comprised therein, is integrated in the n_-well technology in the same way as a first resistor Ra and a second resistor Rb are integrated in the current controlled summing regulator CCSR. Furthermore, the circuit of the voltage-to-current converter VCC must be designed in a way that the current-to-voltage converter t, connected between said converter and a Vdd terminal of a high-supply voltage, produces a control potencial V at the input of said converter VCC, the temperature characteristics of which control potential V includes temperature properties of a quotient $V_{PTAT}/R$ between the voltage $V_{PTAT}$ of the PTAT-voltage source and the resistance of the resistor R.

According to the invention the first current generator t1 and the second current generator t2 are controlled by said control potential V so that they generate the first current I1 and the second current I2, respectively, the temperature characteristics whereof are equal to the temperature characteristics of said quotient $V_{PTAT}/R$. The first current I1 and the second current I2 are conducted to a first input terminal X and to a second input terminal Y; Y', respectively, in the current controlled summing regulator CCSR.

Preferably, the first current generator t1 and the second current generator t2 are selected in a way that the second current I2 is higher than the first current I1.

The first current I1 is conducted to the first terminal X on the first connection of a composition of series connected first resistor Ra and the second resistor Rb. The second connection of said resistor composition is grounded. Between the first terminal X and the ground the bipolar transistor T; T' is diodelike forward connected, as it will be explained later with regard to a specific embodiment. The second current I2 is conducted to a second terminal Y, which is preferably a common connection Z of the first resistor Ra and the second resistor Rb. In a variant embodiment as shown in FIG. 2 I2 is conducted to the sliding second terminal Y' on the second resistor Rb to allow adjustment of the reference voltage Vr. The common connection Z of the first resistor Ra and the second resistor Rb simultaneously represents the output of the source of a temperature independent low reference voltage Vr according to the invention.

In the first embodiment of the source of a temperature independent low reference voltage Vr according to the invention an emitter of the vertical bipolar pnp transistor T is connected to said first terminal X, whereas the collector and base of said transistor are grounded.

In the second embodiment of the source of a temperature independent low reference voltage Vr according to the invention a MOS transistor T' is connected between said first terminal X and the ground like a diode (FIG. 2).

The current-to-voltage converter t controlls the first and the second current generators t1, t2, the current generators t1, t2 acting as a current mirror and being implemented as forward connected MOS transistors.

The circuit according to the invention in the described embodiments is implemented in the 0.6 μm standard CMOS technology. It can function at the supply voltage Vdd below 0.8 V; the lowest supply voltage in the first embodiment is equal to the sum of the voltage across the current generator and the voltage Vbe of the conductively polarized base-emitter junction in the vertical bipolar transistor, amounting to 0.6 V at the room temperature, and in the second embodiment, when implemented just by means of MOS transistors, it is equal to the sum of the highest threshold voltage Vt of the transistor and of the double saturation voltage of the transistor channel, i.e. 0.85 V at −50° C. and 0.6 V at 150° C. The supply voltage Vdd is higher at low temperatures—in FIG. 7 the supply voltage Vdd dependence of the reference voltage Vr at temperatures −50° C., 50° C. and 150° C. is represented for the first embodiment—and vice versa, because at lower temperature the voltages Vbe and Vt are lower. The circuit of the invention in the first embodiment provides reference voltage of 0.35 V and in the second embodiment 0.55 V and its value does not change noticeably with the supply voltage Vdd (FIG. 7). Without any adjusting the reference voltage remains practically constant in the temperature range from −50° C. to 150° C. Power consumption of the circuit of the invention is 1 μW or less.

The source of a temperature independent low reference voltage Vr according to the invention functions as follows.

The whole second current I2 conducted to the second terminal Y in the current controlled summing regulator CCSR from the second current generator t2 flows into the second resistor Rb—Ia being positive (FIG. 5)—below temperature T*, when the voltage Vbe of the conductively polarized base-emitter junction in the vertical bipolar transistor T (the first embodiment) is higher than the reference voltage Vr on the connection Z. The second current I2 contributes to the voltage across the second resistor Rb proportionally to $V_{PTAT}$. The first current I1 conducted to the current controlled summing regulator CCSR from the first current generator t1, in the first terminal X, branches into a current Ia, acting as regulation current within the current controlled summing regulator CCSR and flowing through the resistors Ra and Rb to the ground, and into a current The flowing into the emitter of the vertical bipolar transistor T. The temperature dependence of the first current I1 and of the second current I2 for the supply voltage of 0.9 V in the first embodiment is represented in FIG. 3. The voltage Vbe is set up by the current Ibe—its temperature dependence at the supply voltage of 0.9 V is represented in FIG. 4—and its temperature coefficient is therefore negative. Below the temperature T* the voltage Vbe exceeds the reference voltage Vr, being equal to the voltage drop of the sum of the currents I2 and Ia across the second resistor Rb, by the voltage drop of the current Ia across the first resistor Ra. The current Ia is regulated by means of the voltage Vbe (Ia=Vbe/(Ra+Rb)) and has temperature properties of $V_{PTAT}$ and of the resistors within the circuit. Said summing and regulation result in the reference voltage Vr which is not temperature dependent.

It is evident from FIG. 4, that The increases faster at a lower temperature than at a higher temperature. With the temperature increasing the current Ia into the resistor Ra decreases, above the temperature T*, however, the direction of the current Ia is reversed (FIG. 5) and also part of the second current I2 contributes to the current Ibe. With the temperature increasing also the voltage Vbe decreases at a rate of 2 mV/K and finally the resistance of the resistors Ra, Rb increases at a rate of 0.007 $K^{-1}$. Due to an equally high positive temperature coefficient of the resistance of the resistor R the first current I1 and the second current I2 significantly decrease, when the temperature increases, and the increase of the current Ibe becomes slower. The source of a temperature independent low reference voltage Vr according to the invention functions correctly up to the temperature so high, up to which that part of the second current I2, flowing as the current Ib through the second resistor Rb, is sufficient to generate reference voltage Vr. Preferably the first current I1 is adjusted to be lower than the second current I2 in both embodiments.

Temperature stability of the reference voltage Vr (FIG. 6) in the circuit of the invention is achieved by correction of negative temperature dependence of Vbe or Vt of the diodelike-connected transistor T; T' by means of temperature dependent voltage decrease on the second resistor Rb due to a current, as defined by $V_{PTAT}$, and of a steep exponential dependence of the current Ibe. On the other hand, the level of the voltage Vbe is adjusted with respect to a level of the reference voltage Vr.

Low and temperature independent reference voltage Vr is achieved by means of the current controlled summing regulator CCSR owing to the following characteristics of the circuit of the invention: the resistors R, Ra, Rb have a high positive temperature coefficient; both members of the regulation loop and the summing feedback loop are regulated by the currents I1 and I2, the generation of which is controlled by the quotient $V_{PTAT}/R$; by the regulated voltage in the feedback loop through Ra regulates the current Ibe, whereby the temperature dependence of the voltage Vbe is linearized. A double regulation loop is built in, which is controlled solely by temperature: $I1/Ia=f_1(Vbe)$ and $Vbe=f_2(I1-Ia)$.

In the second embodiment of the circuit according to the invention the threshold voltage Vt of the diodelike connected MOS transistor T' is established on the first terminal X. Channel saturation voltage is low, which is achieved by a large geometry of the transistor T' and by a current Ids, which guarantees operation in a sub-threshold regime.

FIGS. 1 and 2 show a modification of the circuit of the first and second embodiment, which in a preferable way allows adjustment of the reference voltage Vr, in that the second current I2 is conducted to the appropriate terminal Y' on the second resistor Rb. In this way the regulation loop of the circuit of the invention is preserved and the voltage of the fixed member can be adjusted digitally. The relation I2/I1 of the second and first currents is preserved and the current Ibe is simultaneously compensated.

The invention claimed is:

1. Low reference voltage source, whereas the reference voltage Vr is temperature independent, comprising a low voltage-$V_{PTAT}$ source, the voltage $V_{PTAT}$ being proportional to the absolute temperature, characterized in that it comprises a voltage-to-current converter (VCC), comprising the low voltage-$V_{PTAT}$ source and a resistor (R) and a current I at its input across a diode element (t) produces a control potential V, the temperature characteristics of which includes the temperature characteristics from the quotient $V_{PTAT}$/R between the voltage $V_{PTAT}$ and the resistance of the resistor (R), that a first current generator (t1) and a second current generator (t2), both being controlled by the control potential V, generate a first current I1 and a second current I2, respectively, the temperature characteristics of which include the temperature characteristics of the said quotient $V_{PTAT}$/R, that the first current I1 is conducted to a first terminal (X) on a first connection of a composition of series connected first resistor (Ra) and a second resistor (Rb), a second connection of said composition being grounded, that a transistor (T; T') is diodelike forward connected between the first terminal (X) and the ground, that the second current I2 is conducted to a second terminal (Y) on a common connection (Z) of the first resistor (Ra) and the second resistor (Rb), that the reference voltage Vr is tapped from the common connection (Z) of the first resistor (Ra) and the second resistor (Rb)

and that the first resistor (Ra) and the second resistor (Rb) are manufactured in the n-well technology in the same way as the resistor (R) within the voltage-to-current converter (VCC).

2. Low reference voltage source as recited in claim 1, characterized in that said transistor is a vertical bipolar pnp transistor (T) havining an emitter connected to the first terminal (X), the collector and the base of said transistor are grounded.

3. Low reference voltage source as recited in claim 1, characterized in that said transistor between the first terminal (X) and the ground is a MOS transistor (T') connected like a diode.

4. Low reference voltage source as recited in claim 2, characterized in that the second current I2 is conducted to the second terminal (Y') by a sliding terminal on the second resistor (Rb).

5. Low reference voltage source as recited in claim 4, characterized in that the first current generator (t1) and the second current generator (t2) are selected so that the second current I2 exceeds the first current I1.

6. Low reference voltage source as recited in claim 5, characterized in that the first and the second current generators (t1, t2) are forward connected MOS transistors.

* * * * *